United States Patent [19]

Weiss

[11] 4,410,779

[45] Oct. 18, 1983

[54] COMBINATION MICROWAVE OVEN CONTROL SYSTEM

[75] Inventor: Bernard J. Weiss, Barto, Pa.

[73] Assignee: Raytheon Company, Lexington, Mass.

[21] Appl. No.: 298,868

[22] Filed: Sep. 3, 1981

Related U.S. Application Data

[63] Continuation of Ser. No. 120,013, Feb. 8, 1980, abandoned, which is a continuation of Ser. No. 892,538, Apr. 3, 1978, abandoned.

[51] Int. Cl.[3] ..... H05B 6/72

[52] U.S. Cl. ..... 219/10.55 F; 219/10.55 R; 219/10.55 B

[58] Field of Search ..... 219/10.55 F, 10.55 R, 219/10.55 D, 10.55 B, 10.55 E

[56] References Cited

U.S. PATENT DOCUMENTS

| | | | |
|---|---|---|---|
| 2,748,239 | 5/1956 | Long et al. | 219/10.55 E |
| 2,909,635 | 10/1959 | Haagensen | 219/10.55 E |
| 2,920,174 | 1/1960 | Haagensen | 219/10.55 F |
| 2,961,520 | 11/1960 | Long | 219/10.55 F |
| 3,196,243 | 7/1965 | Schall | 219/10.55 B |
| 3,265,780 | 8/1966 | Long | 219/10.55 F |
| 3,436,507 | 4/1969 | Puschner | 219/10.55 F |
| 3,471,671 | 10/1969 | Puschner | 219/10.55 F |
| 3,692,967 | 9/1972 | Hashimura | 219/10.55 F |
| 3,746,823 | 7/1973 | Whiteley | 219/10.55 F |
| 3,767,884 | 10/1973 | Osepchuk | 219/10.55 F |
| 3,872,276 | 3/1975 | Corcoran et al. | 219/10.55 F |
| 3,920,944 | 11/1975 | Constable | 219/10.55 M |
| 4,019,010 | 4/1977 | Tanaka et al. | 219/10.55 F |
| 4,028,521 | 6/1977 | Uyeda et al. | 219/10.55 F |
| 4,037,071 | 7/1977 | Kaufman, Jr. et al. | 219/10.55 F |
| 4,053,730 | 6/1977 | Baron et al. | 219/10.55 F |
| 4,092,513 | 5/1978 | Rasmussen | 219/10.55 F |
| 4,105,886 | 8/1978 | Baron et al. | 219/10.55 F X |
| 4,342,896 | 8/1982 | Teich | 219/10.55 F |

FOREIGN PATENT DOCUMENTS

| | | | |
|---|---|---|---|
| 1440333 | 4/1969 | Fed. Rep. of Germany | 219/10.55 F |
| 45-32474 | 10/1970 | Japan | 219/10.55 F |

*Primary Examiner*—B. A. Reynolds
*Assistant Examiner*—Philip H. Leung
*Attorney, Agent, or Firm*—William R. Clark; Joseph D. Pannone

[57] ABSTRACT

A self-cleaning combination microwave and electrically heated oven having a rotating microwave radiator positioned beneath a microwave transparent protective cover of high temperature material with air being blown by a microwave source into the oven through the radiating system and impinging on the cover, thereby cooling and assisting in preventing deposition of cooking vapors on the cover. During the self-cleaning cycle, air is drawn by convection through the oven to maintain the radiating system below 650° F. while the interior oven surfaces are raised to temperatures above 900° F. by resistive-heating elements in the oven.

3 Claims, 5 Drawing Figures

FIG. 4
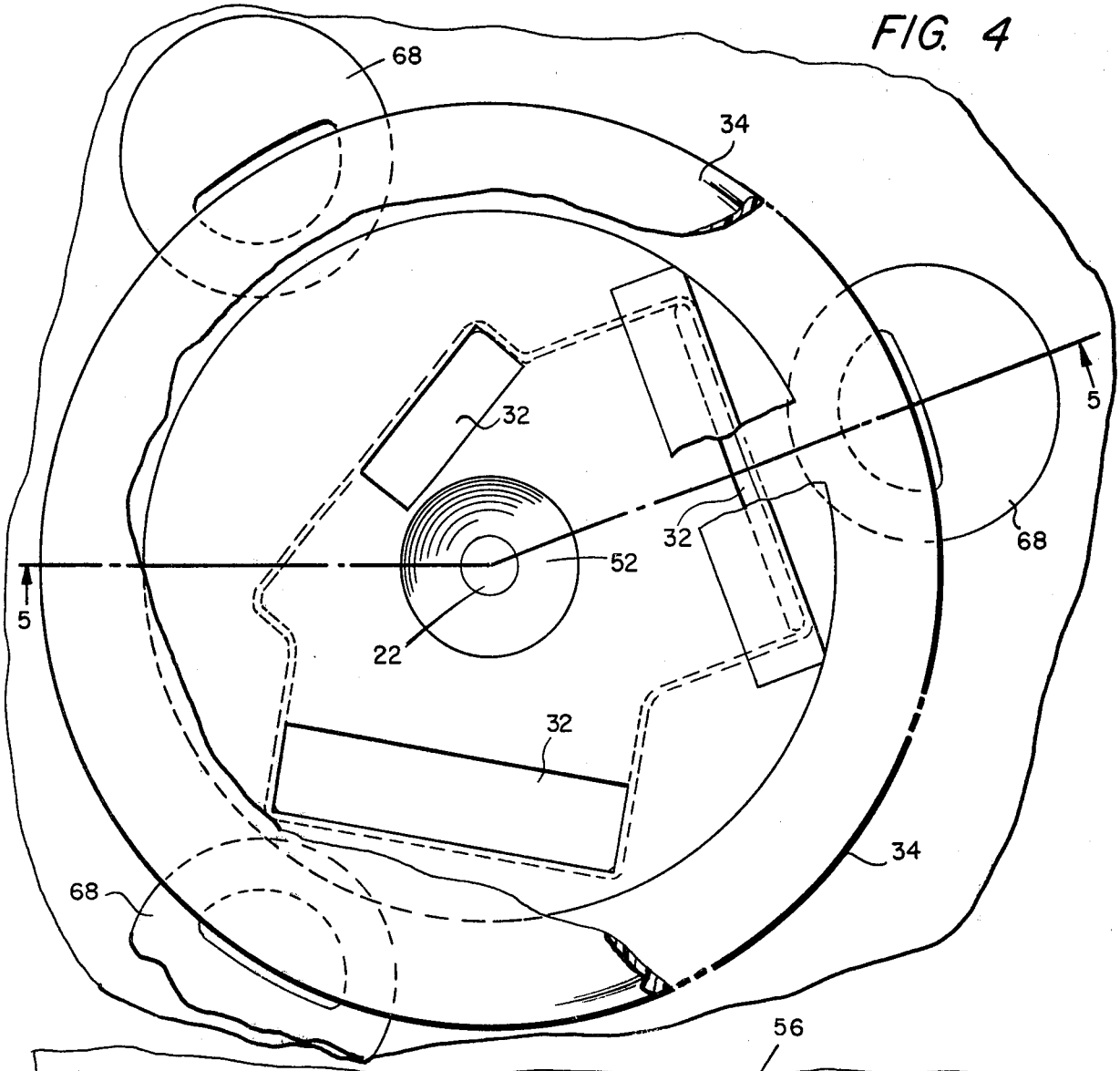
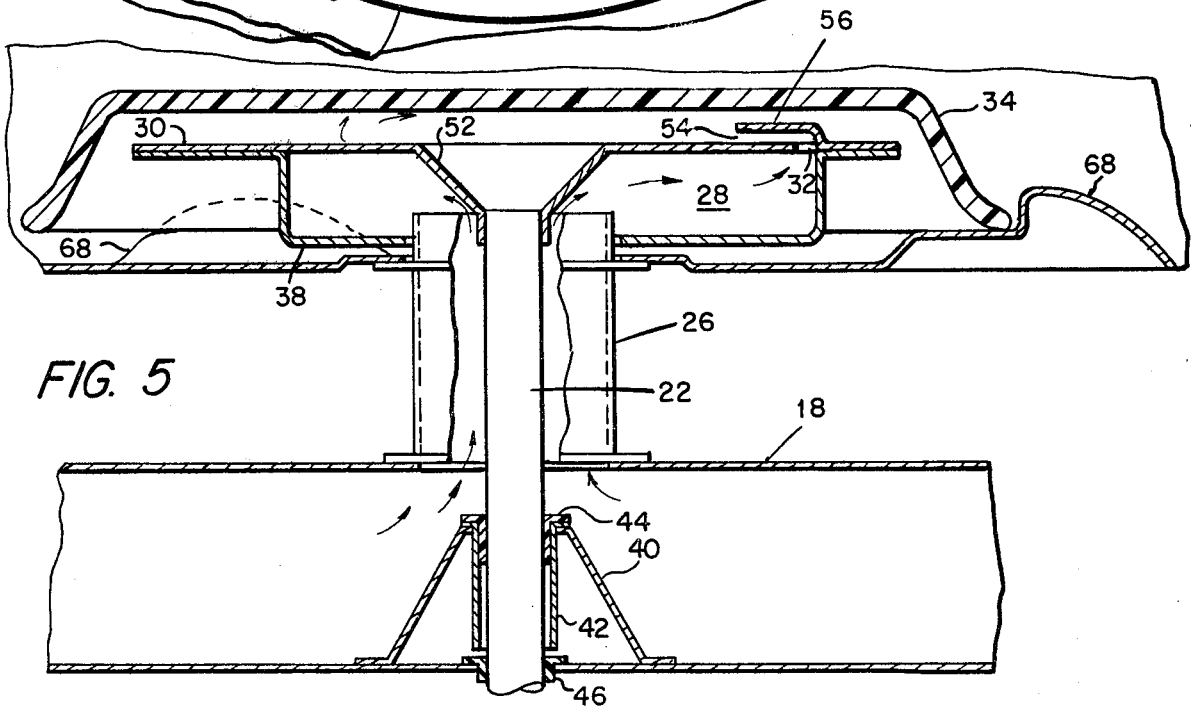
FIG. 5

COMBINATION MICROWAVE OVEN CONTROL SYSTEM

CROSS-REFERENCE TO RELATED APPLICATIONS

This is a continuation of application Ser. No. 120,013, filed Feb. 8, 1980, which is a continuation of application Ser. No. 892,538, filed Apr. 3, 1978 (now both abandoned).

Application Ser. No. 855,051, filed Nov. 25, 1977, by Bernard J. Weiss and assigned to the same Assignee as this application, is hereby incorporated by reference and made a part of this disclosure.

BACKGROUND OF THE INVENTION

In the aforementioned application, there is disclosed a combination microwave and electrically heated oven in which microwave energy is supplied at the bottom of the oven. However, in such an oven, the radiating applicator is beneath the food body being heated so that spillage or other undesirable effects can occur which reduce the efficiency of the cooling system. In addition, if high temperature self-cleaning is used, the radiator must be made of material, such as steel, which will withstand such temperatures.

SUMMARY OF THE INVENTION

This invention discloses that a desirable heating pattern can be achieved with a multi-element radiator fed from a common junction and producing a plurality of substantially directional patterns of radiation toward a body to be heated with a smaller spacing between the radiator elements than previous radiators by causing at least one of said elements to radiate a pattern whose polarization lies in a plane having a substantially different angle to the plane of radiation polarization plane, the radiator pattern produced by a different element of said radiator. More specifically, the polarization of one of said radiation patterns lies in the plane substantially parallel to the axis of rotation of the radiator. The radiator elements are preferably ports in a waveguide plenum fed by a common junction such as a coaxial line with the microwave energy arriving at different radiating elements in respectively different phases. The improved uniformity of the heating pattern in a food body produced by such independent radiation patterns occurs even when the food body is positioned directly in the direct radiation patterns of the radiating elements so that a substantial portion of the energy is absorbed by the food body as direct radiation from the radiator rather than reflected from the cavity walls.

This invention discloses that a stationary cover which is transparent to microwave energy may be positioned over the radiator in the oven cavity to provide protection of the radiator from spillage of food or condensation of cooking vapors on the radiator. More specifically, the transparent cover is supported on bumps on the bottom wall of the oven cavity providing spaces through which air passes through the oven. The air directed out through the radiator ports past inner surface portions of the cover adjacent the radiator to maintain the radiator at a temperature below that of the oven when electrical resistance heating is used. More specifically, the cover may be, for example, a commercially available high temperature material such as a pie plate sold under the trade names Pyroceram or Rayceram which will withstand temperatures in excess of 1000° F.

The pie plate cover is inverted in a stationary position over the rotating radiator and acts as a thermal shield during high temperature oven operations such as a cleaning cycle to allow the radiator to remain at temperatures substantially below temperatures of the oven wall surfaces.

In accordance with this invention, the walls of the oven are preferably made of conventional steel coatel with high temperature ceramic such as enamel so that in the absence of large load bodies, microwave energy being radiated into the oven will be partially absorbed by the oven walls, hence preventing the build-up of undesirable high intensity field patterns in the oven. The radiator may be of a high conductivity metal such as aluminum which is protected from the high temperature of the oven.

This invention further discloses a microwave oven having a door seal structure incorporated with a conventional high-temperature gas vapor seal for a combination oven and a low microwave loss microwave choke seal structure between the vapor seal and the oven interior which allows air to be blown continuously through the oven without substantially reducing the heating rate of the food body by microwave energy or by resistive heating. More specifically, the choke structure may be formed either in the door or in the oven wall and provides a high impedance in series with the input transmission line structure at the predominant operating frequency range of the microwave oven, such as, for example, between 2.4 to 2.5 KMH.

In accordance with this invention, additional resiliency may be provided for the resilient high-temperature vapor seal by supporting wire mesh in tubular form on a tubular fiberglass braid in turn supported on a tubular steel mesh structure of greater diameter wire to provide spring action.

In accordance with this invention, sealing action of the microwave energy in the predominant frequency range may be enhanced by providing means in an input transmission line section of a choke-type microwave door seal for inhibiting transmission of such microwave energy periphery around the said input transmission line structure. More specifically, such means may comprise impedance discontinuities such as slots in one of the walls of said input transmission line structure. Further in accordance with this invention, such slots preferably extend through the wall into the choke structure to further assist in inhibiting periphery mode propagation in the choke structure. Such a choke seal is positioned inside the oven between the high-temperature vapor seal and the oven interior.

In accordance with this invention, a food body may be positioned on a rack in the radiation patterns from a rotating radiator, preferably formed of high conductivity, low loss material such as aluminum, so that a substantial portion of the microwave energy is absorbed on passing through the food body prior to reflection from walls of the oven. Therefore, high efficiency heating may be achieved with microwave energy even though the walls of the oven are made of inexpensive high-temperature material such as enameled steel, which slightly absorbs microwave energy. In accordance with this invention, the magnetron may be tightly coupled to the oven through a coupling mechanism such as a waveguide, coaxial transition and multi-element radiator thereby increasing the efficiency of the magnetron and hence conversion of input electrical energy to microwave energy coupled into the body to be heated. More specifically, where a small food body on a metal dish is placed in the oven, substantial microwave energy which is radiated into the oven, is reflected back to the rotating radiator from the metal dish or the opposite wall of the oven will arrive at a common junction, such as the central conductor of a coaxial line transition, with substantially different phases so that relatively low amounts of energy are reflected back into the magnetron.

In addition, an electric resistance heater, which may be positioned directly in the top of the oven while extending through microwave chokes in the oven wall for connection to an electrical power source, is used for heating the oven, either separately or in combination with microwave energy, and is used for treating the oven walls during the self-cleaning cycle.

When microwave energy alone is being used, deposition of cooking vapors on the surfaces through which the microwave energy passes is inhibited by re-heating of such surfaces by the microwave energy. However, this somewhat reduces the efficiency of the transfer of microwave energy to the body to be heated, and accordingly, air directed past the surface of the cover is first heated by passing such air by the generator, such as a magnetron, to cool the magnetron and to heat the air to a temperature on the order of 40° F. above room temperature, and hence above 100° F., so that substantially no cooking vapors will deposit on the transparent cover. In accordance with this invention, the air heated by the magnetron flows through the oven without substantially cooling the oven so that clouds of steam or other cooking vapors are carried away during the cooking process and are not emitted from the oven through the door when it is opened.

BRIEF DESCRIPTION OF THE DRAWINGS

Other and further objects and advantages of this invention will be apparent as the description thereof progresses, reference being had to the accompanying drawings wherein:

FIG. 4 illustrates a fragmentary expanded portion of FIG. 3; and

FIG. 5 illustrates a vertical sectional view of the oven portion of FIG. 4 taken along line 5—5 of FIG. 4.

DESCRIPTION OF THE PREFERRED EMBODIMENT

Figure 2:
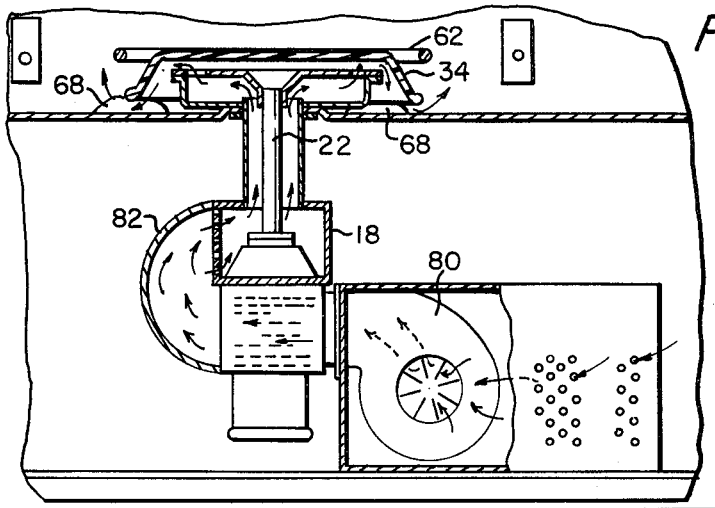
FIG. 2 illustrates a vertical sectional view of the oven of FIG. 1 taken along line 2—2 of FIG. 1.
Figure 1:
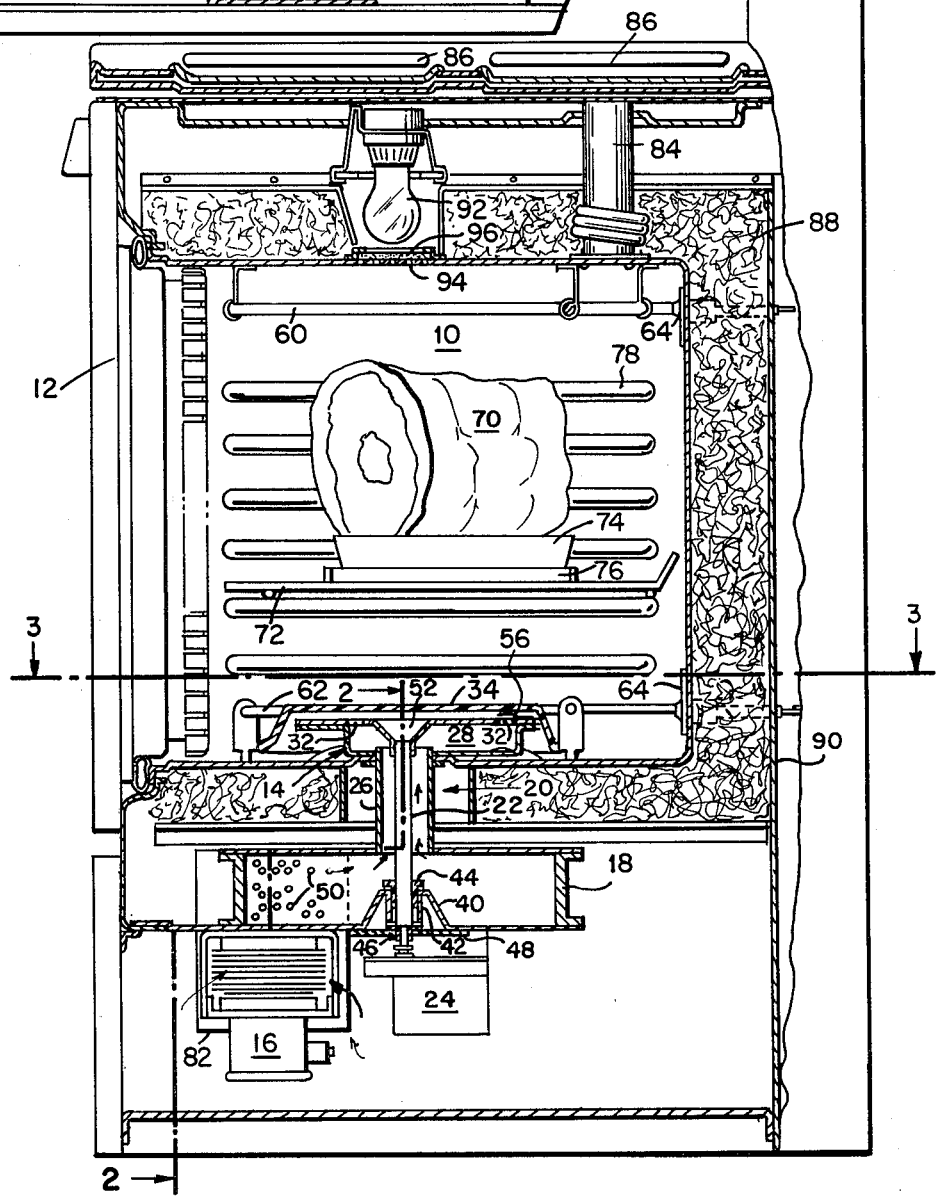
FIG. 1 illustrates a vertical sectional view of a combination microwave oven embodying the invention with the door closed.
Figure 3:
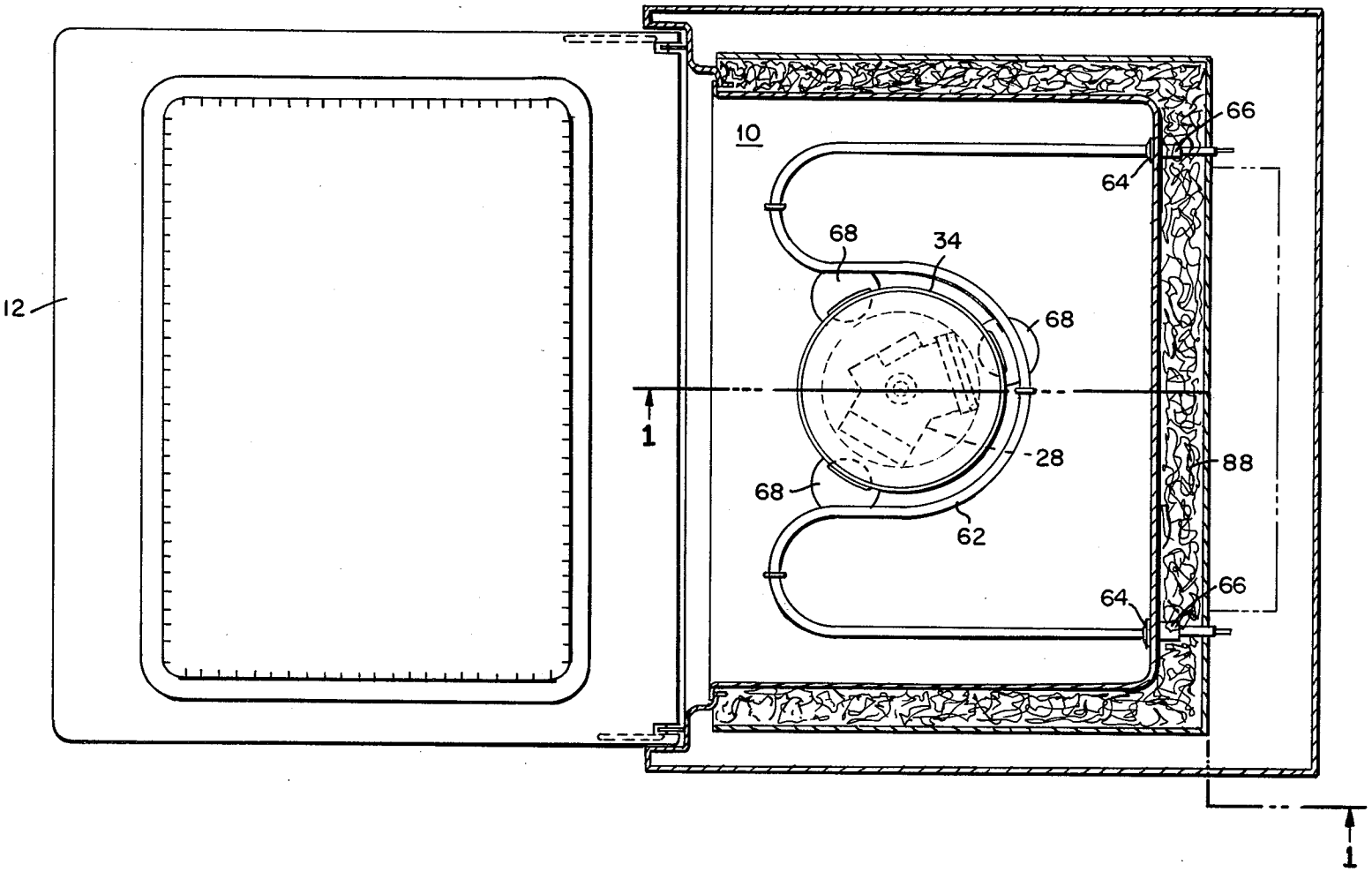
FIG. 3 illustrates a horizontal sectional view of the oven illustrated in FIG. 1 taken along line 3—3 of FIG. 1 but with the door open.

Referring now to FIGS. 1, 2, and 3, there is shown a microwave cavity 10 closed by a door 12 and supplied with microwave energy from a rotating radiator 14 in the bottom of the oven. Radiator 14 is fed with microwave energy from a magnetron 16 through a waveguide 18 and a coaxial line 20 having a central conductor 22 rigidly connected to rotating radiator 14 and extending through waveguide 18 to a gear reduction motor 24. Motor 24 is attached to the bottom of waveguide 18 and rotates central conductor 22 to rotate radiator 14. Coaxial line 20 has an outer conductor 26 rigidly connected to the upper wall of waveguide 18 and extending through the bottom wall of enclosure 10 into a plenum 28 in radiator 14.

As shown more specifically in FIG. 5, plenum 28 comprises an upper plate 30 connected to central conductor 22 and having a plurality of ports 32 therein spaced at different distances at the axis of conductor 22. Microwave energy is radiated from plenum 28 into the oven enclosure 10 through ports 32 and through a stationary cover 34 which is transparent to microwave energy and which prevents cooking spillage or vapors from impinging on radiator 14.

A lower plenum member 38 of radiator 14 prevents radiation of microwave energy radially outwardly and directs it through the ports 32, and the lower surface of plenum member 38 is positioned sufficiently above the bottom wall of enclosure 10 for radiator 14 to rotate freely. An aperture in plenum member 38 surrounds the upper end of outer coaxial conductor 26 which thus extends slightly into plenum 28, thereby substantially preventing microwave energy from radiating into enclosure 10 from beneath radiator 14. The length of outer conductor 26 which extends into plenum 28 may be adjusted to improve impedance matching conditions.

As shown in FIG. 1, a substantially conical waveguide to coaxial line transition member 40 is formed by die-stamping the sheet metal bottom wall of guide 18 upwardly in conical shape surrounding central conductor 22. A tubular member 42 is welded to the top of conical member 40 and extends downwardly surrounding conductor 22 for distances equal to an effective electrical quarter wavelength at the frequency of magnetron 16 so that it produces a choking action to energy attempting to escape from waveguide 18 toward motor 24. A sleeve bearing 44 of dielectric material is positioned between tubular member 42 and conductor 22 to insure against arcing in the bearing. Conductor 22 is reduced in diameter just below the lower end of tubular member 42 producing a land resting on an oil-filled bronze bearing 46 supported in a plate 48 which attaches motor 24 to the bottom of guide 18. The ends of waveguide 18 are closed by shorting members which are positioned to provide a substantially flat standing wave ratio between the output probe of magnetron 16 and central conductor 22.

As shown in FIGS. 4 and 5, radiator ports 32 are each fed with microwave energy through separate plenum waveguide sections whose axes are at 120° to each other and whose inner ends form a common junction region containing the central conductor 22. An impedance matching conical portion 52 formed in plenum plate 30 is welded to conductor 22 to increase its radius as it approaches upper plate 30 of plenum 28. Waveguide section walls which are formed by the sides of plenum 28 are made of different lengths so that energy radiated into plenum 28 from central conductor 22 arrives at ports 32 in respectively different phases. Reference may be had to the aforementioned copending application for an additional description of the details of such a radiator.

In accordance with this invention, one of the ports 32 has a vertical aperture 54 forming a radiation polarization pattern which is parallel to the axis of rotation of radiator 14. Thus, the composite of the heating pattern produced by the radiation patterns from ports 32 is different at different distances above radiator 14, and the waves from aperture 54 are vertically polarized so the waves will arrive at the food body in different phases and polarizations, preferably selected so that reflections of the waves back to radiator 14 will have substantially cancellation of the electrical field vectors at the junction of the plenum waveguides at central conductor 22 to re-reflect such energy back through ports 32 into the cavity 10. This effect is preferably chosen to be maximized when the microwave cavity has no food body positioned therein or when the food body is positioned in a metal dish. Under these conditions it therefore is possible to couple magnetron 16 to the oven to operate close to its maximum efficiency for converting its electrical energy input to microwave energy output while maintaining low microwave energy field gradients and hence low wall losses in the waveguide 18.

In accordance with this invention, oven cavity 10 may be made of relatively lossy or energy absorbing material which may absorb, for example, a few percent of microwave energy impinging thereon and reflecting therefrom. Such material may be, for example, conventional sheet steel used in conventional ovens and coated with conventional enamel, all in accordance with the well-known practice. In addition, conventional broiler and heating units 60 and 62 may be positioned adjacent the upper and lower walls of the cavity 10 held by conventional fasteners in accordance with well-known practice. However, in the case of the heating unit 62, it preferably is formed in arcuate shape so that its closest portion is positioned around, and spaced from, the periphery of cover 34 so as not to overheat the cover 34.

In accordance with this invention, elements 60 and 62 are shielded electric resistance heating units connected to power through the back wall of cavity 10. The outer shields of the units are grounded to the wall of cavity 10 by tabs 64 which are attached, for example, by welding or crimping to the shields and which are screwed to the back wall of cavity 10. Tubular microwave choke elements 66, whose lengths are preferably an effective quarter wavelength of the microwave frequency in cavity 10, are attached by welding to the outside of oven cavity 10 and surrounding the shields but spaced therefrom by an enamel coating on elements 66. Electrical connections to power and control terminals may be made to the heater and broiler units in accordance with well-known practice.

Any desired configuration can be used for the radiator 14. An example providing good results at 2.45 KMH uses waveguides which are 4 inches wide and 1 inch high fed by a central conductor 22 which is $\frac{1}{2}$ inch in diameter and an outer conductor 26 which is 2 inches in diameter. The waveguide 18, which may be 4 inches wide, is shown as 2 inches high, and the distances from one shorting member 50 to the center of magnetron output to the axis of conductor 22 and to the other shorting plate 50 are $\frac{3}{4}$ inch, 5 inches, and $10\frac{1}{4}$ inches, respectively.

A food body 70 may be positioned, for example, on a rack 72 above radiator 14 in a dish 74, preferably transparent to microwave energy, and resting on a plate 76 of material which is transparent to microwave energy, such as pyroceram. Rack 72 may be, for example, a welded wire rod having apertures substantially greater than $\lambda/2$ and adjustably supported at different levels in cavity 10 by means of grooves 78 in the side walls of cavity 10 or in any other desired manner.

Air from a blower 80 is blown through the cooling fins of magnetron 16 and then into oven 10, for example, through apertures in waveguide 18 via duct 82, transmission line 20, apertures 32 and spaces between the bottom lip of cover 34 and the bottom of oven 10 where the lip of cover 34 rests on raised positioning bumps 68 formed in said oven bottom wall, past heating unit 62 to conduct that air past food body 70 during cooking. The air then exists through a canister 84 at the top of the oven to the center of a surface burner unit 86.

During the oven's self-cleaning cycle, the temperature of the oven is raised to a temperature between 750° F. and 1100° F. by energizing upper heating unit 60 to vaporize deposits on the wall of oven 10 and to allow the vapor to move by convection out through canister 84 which may contain a catalyst to complete oxidation of the vapor in accordance with well-known practice.

Air is also drawn by convection into the oven past radiator 14 and the inner surface of cover 34, which may be, for example, Pyroceram, thereby maintaining radiator 14 below the temperature where aluminum would soften while permitting the upper surface of cover 34 to be heated to self-cleaning temperatures for Pyroceram surfaces, such as 700° F. to 900° F.

Thermal insulation 88 of, for example, fiberglass is provided around oven 10 in a well-known manner surrounded by a metal skin 90. A light 92 may illuminate oven 10 through an apertured metal plate 94 covered with a translucent pyroceram plate 96.

In accordance with this invention, door 12 has a high temperature vapor seal which is prevented from absorbing large amounts of microwave energy from the interior of enclosure 10 by a microwave seal positioned between said enclosure interior and the vapor seal. The seal is described in greater detail in said copending application.

The dimensions of the apertures 32 and vertical aperture 54 may be of any desired size and are shown here, by way of example, scaled to produce an improved heating pattern with a reduced size radiator from that disclosed in the aforementioned copending application, however with the distance and size of the slot 32 covered by the lip 56 is closer to the axis of rotation of the radiator 14 than the farthest slot disclosed in said copending application. The lip 56 covering this slot 32 causes the average of the radiation pattern radiating from the vertical aperture 54 to be directed at an angle toward the rotational axis of radiator 14. The shape of patterns of radiation from the vertical aperture 54 and the other apertures 32 are governed by size and shape of the apertures 32 and 54. Since the radiation pattern from aperture 54 is directed inwardly toward the axis of rotation, additional heating occurs in the center of the food body. Such a heating is different for different positions of the rack 72 in the support grooves 78. When the rack is in its uppermost position a large portion of the microwave energy from aperture 54 is directed across the microwave oven beneath the food body and is reflected from the walls. However, when the rack is in its lowermost position a larger portion of the energy from the vertical aperture 54 impinges directly on the food body, particularly if the food body is large, and it is important to couple substantial amounts of microwave energy into the center of the food body. The other ports 32 radiate waves that are horizontally polarized in a radiation pattern whose average direction is upward, substantially parallel to the rotational axis.

In such a radiating structure provides an improved heating pattern in which the major portion of the microwave energy may impinge directly on a food body before reflection from the oven walls and the ports are further de-coupled from each other for direct radiation so that radiation from one port does not affect the radiation pattern from the other ports prior to impingement of the pattern energy on the walls of the oven. This is achieved even though the spacing between the ports is less than in the structure of the aforementioned copending application so that the cover 34 positioned over the radiation may be of a lesser size.

Air which is blown through the radiator 14 into the oven largely exits from the radiator through the ports 32 and impinges on the inner surface of the cover 34 so that it flows along this surface and out under the lip of the cover 34 between the bumps 68 which support the cover lip in a raised position above the floor of the oven 10.

This completes the description of the embodiments of the invention illustrated herein. However, many modifications thereof will be apparent to persons skilled in the art without departing from the spirit and scope of the invention. For example, other sources of auxilliary heat such as gas flames or hot air can be used in place of electrical resistance heaters and any desired system of timers and/or controls can be used. Accordingly, it is intended that this invention be not limited to the terms of the specific embodiment herein except as defined hereby by the appended claims.

What is claimed:

1. A self-cleaning combination microwave and conventional heat oven comprising:

a microwave energy conductive enclosure containing an elongated resistive heating element adjacent to the floor thereof and substantially parallel thereto;

a magnetron positioned outside said enclosure;

a multi-element rotating microwave radiator positioned in the central bottom region of said enclosure;

a stationary concave dish having its opening facing said radiator, said dish being transparent to said microwave energy, the sides of said dish extending between said radiator and said resistive heating element for providing thermal insulation for said radiator, the rim of said dish being removably supported by at least three upward protrusions spaced from each other in said floor of said enclosure, said protrusions elevating said rim above said floor of said enclosure defining gaps between portions of said rim and said floor; and a waveguide connected to a coaxial conductor for coupling said microwave energy from said magnetron to said radiator, said waveguide and said coaxial conductor providing a path for natural convection air into said cavity during self-clean of said oven, a portion of said natural convection air impinging on said radiator to maintain said radiator at a temperature significantly lower than the self-cleaning temperature, said natural convection air flowing through said gaps between said rim and said floor into said enclosure.

2. The oven recited in claim 1 wherein said radiator comprises aluminum.

3. The oven recited in claim 2 wherein said radiator comprises a plate having a substantial horizontal portion.

* * * * *